US007836903B2

(12) United States Patent
Kharag

(10) Patent No.: US 7,836,903 B2
(45) Date of Patent: Nov. 23, 2010

(54) DUAL FOLDED UMBRELLA

(76) Inventor: Lev Kharag, 722 34th Ave., San Francisco, CA (US) 94121

( * ) Notice: Subject to any disclaimer, the term of this patent is extended or adjusted under 35 U.S.C. 154(b) by 136 days.

(21) Appl. No.: 11/949,332

(22) Filed: Dec. 3, 2007

(65) Prior Publication Data

US 2009/0139555 A1 Jun. 4, 2009

(51) Int. Cl.
*A45B 19/10* (2006.01)
*A45B 25/22* (2006.01)

(52) U.S. Cl. ..... 135/25.31; 135/32; 135/33.7

(58) Field of Classification Search ..... 135/98, 135/16, 25.1, 25.3–25.32, 27, 29, 31–32, 135/33.7, 907
See application file for complete search history.

(56) References Cited

U.S. PATENT DOCUMENTS 4,077,421 A * 3/1978 Schultes et al. ..... 135/25.3
4,966,180 A * 10/1990 Lai ..... 135/25.3
5,152,495 A * 10/1992 Jacinto et al. ..... 248/545
5,396,916 A * 3/1995 Boissonnault ..... 135/16
5,906,077 A * 5/1999 Andiarena ..... 52/157
6,035,873 A * 3/2000 Lin et al. ..... 135/25.1
6,244,284 B1 * 6/2001 Wang ..... 135/31
6,474,352 B1 * 11/2002 Lee ..... 135/31
6,681,784 B2 * 1/2004 Chou et al. ..... 135/33.7
7,191,996 B2 * 3/2007 Patsalaridis ..... 248/530
2006/0272687 A1 * 12/2006 Tanner et al. ..... 135/16

* cited by examiner

*Primary Examiner*—Winnie Yip
(74) *Attorney, Agent, or Firm*—Wilson Daniel Swayze, Jr.

(57) ABSTRACT

A beach umbrella with improved sturdiness, durability and ability to keep the shading size maximized, but weight of the structure to the minimum is disclosed. The umbrella may include a poll member, an upper ring member at substantially the top of the poll member, a slider member which is movable along the poll member, a interior rod frame stretching member to pivot with respect to the upper ring member, a support rod frame member to pivot with respect to the slider member and a transfer rod frame member to pivot with respect to the support rod frame member.

16 Claims, 15 Drawing Sheets

DUAL FOLDED UMBRELLA

BACKGROUND OF THE INVENTION

1. Field of the Invention

The present invention relates to a beach, patio, and particularly large size sun shading umbrella which may be on one single pole and more particularly to a sun shading umbrella with improved functionality such as maximizing the shading area, durability and weight for easy carrying capabilities.

2. Description of Related Art

The varieties of beach umbrellas presented on the market have limits for extending shaded area by simple size increase. The today existing constructions can't withhold the increase of the weight of components and a covering canopy with at least doubling the diameter of existing varieties of umbrellas. The increasing of the swiveling affect for the fabric supporting ribs leading to the collapse of the structure.

Utility Pat. No. 6,758,228 discloses the in-folded umbrella. It is characterized for more compact size after folding.

Utility Pat. No. 7,246,629 discloses the beach umbrella comprised a telescoping shank and folding radial frame including ribs each included in a first segment.

However, both patents have constructional problem with a simple tendency to increase size of the umbrella at least twice in diameter. The tremendous construction and canopy weight will create for the supporting ribs a swiveling effect and/or great chance of the umbrella collapsing in different outdoor conditions.

The continuing need for improvement for the increasing size of the beach umbrella covering areas.

SUMMARY OF THE INVENTION

An umbrella to provide shade includes a poll member, an upper ring member at substantially the top of the poll member, a slider member which is movable along the poll member, a interior rod frame stretching member to pivot with respect to the upper ring member, a support rod frame member to pivot with respect to the slider member, a transfer rod frame member to pivot with respect to the support rod frame member.

The slider member may include a first slider arm, and the slider member may include a second slider arm;

The supporting rod frame member may be affixed to a first joint connecting member, and the joint connecting member may include a first joint arm.

The joint connecting member may include a second joint arm, and the transferring rod frame member may be connected to a second joint connecting member.

The second joint connecting member may pivot with respect to the first and second joint arms, and the umbrella may include a pivoting member, the interior rod frame stretching member may pivot with respect to the pivoting member.

The transferring rod frame member may pivot with respect to the pivoting member, and the pivoting member may include a first pivoting arm.

The pivoting member may include a second pivoting arm, and the pivoting member may include a third joint connecting member affixed to the interior rod frame stretching member.

The third joint connecting member may pivot with respect to the first and second pivoting arms, and the pivoting member may include a fourth joint connecting member affixed to the transferring rod frame member.

The fourth joint connecting member may pivot with respect to the first and second pivoting arms, and the pivoting member may be connected to an outer rod frame member.

The umbrella includes a non-continuous covering, and the umbrella may include a continuous covering.

The umbrella may be adapted to move between a first position and second position to display a logo.

BRIEF DESCRIPTION OF THE DRAWINGS

The invention may be understood by reference to the following description taken in conjunction with the accompanying drawings, in which, like reference numerals identify like elements, and in which.

DETAILED DESCRIPTION

The bi-folding increased coverage beach umbrella invention enables to increase shaded covering area to be increased up to double the size of conventional beach or recreational umbrellas on the single pole and yet the present invention achieves a minimum weight increase of the complete construction. These features allow the users to carry the folded increased coverage umbrella to a desired location with ease.

Figure 3:
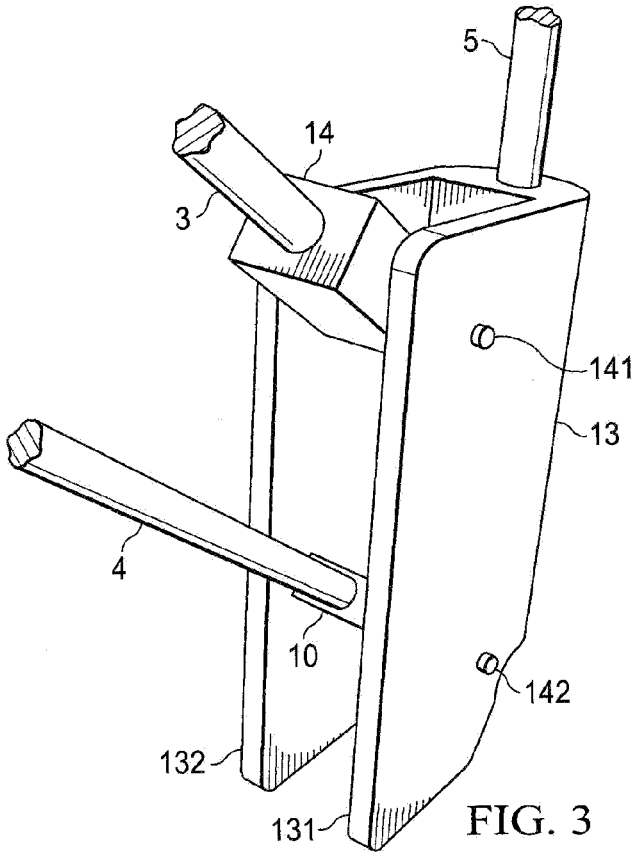
FIG. 3 is a perspective view of another folding double rail joint of the partially folded frame shown in FIG. 1.

The twin rail joint as shown in FIG. 3 achieves extended sturdiness, and the twin-rail joint prevents the swiveling and collapse of the extended folding rod which may be loaded with an extended amount of covering canopy. The top pivot 14 and bottom pivot 15 may be guided by a pair of arms of the joint 13 during open/closed actions and stays open with limited swivels under different outdoor conditions shown in FIG. 4.

Figure 5:
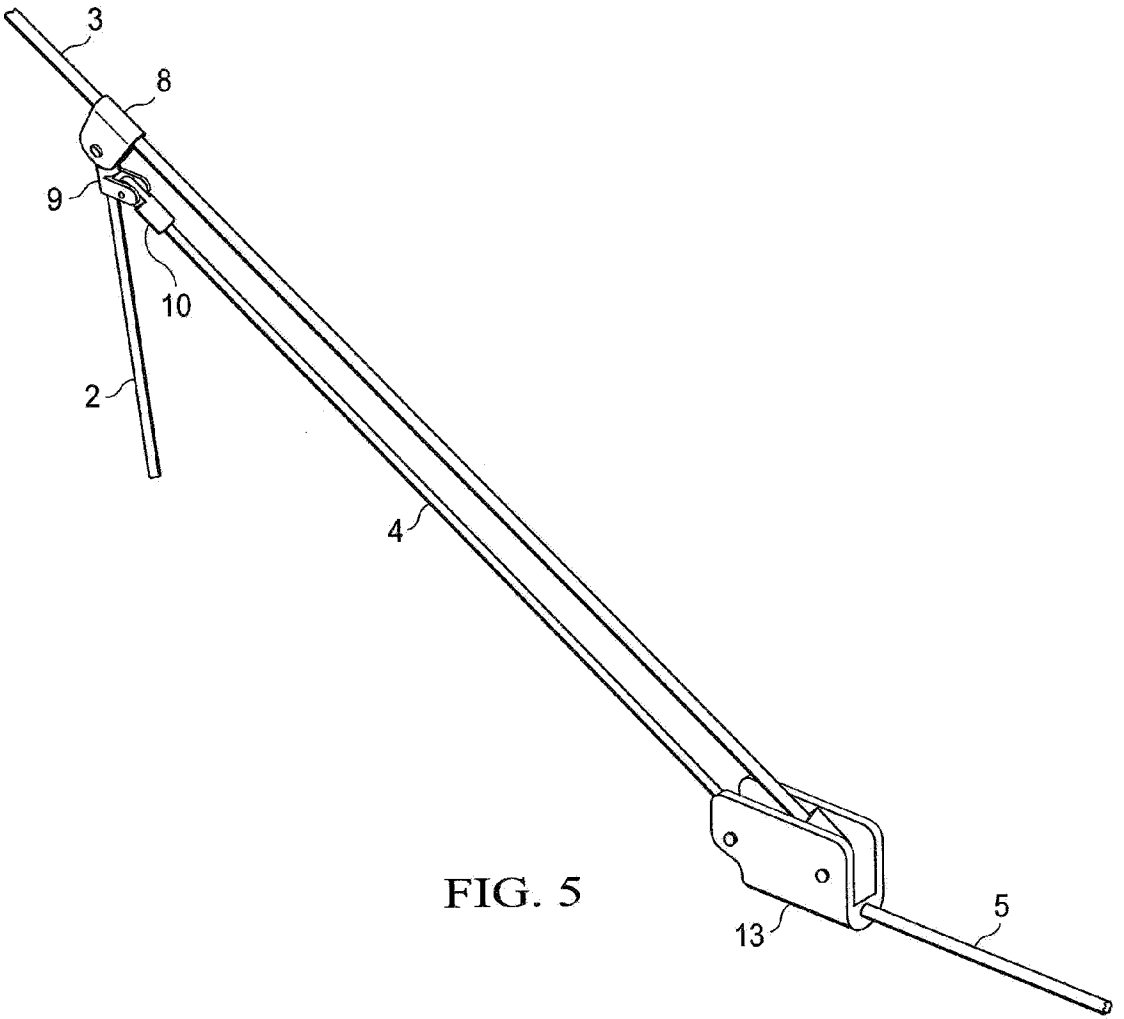
FIG. 5 is a perspective view of the beach umbrella frame segment according to the invention.
Figure 9:
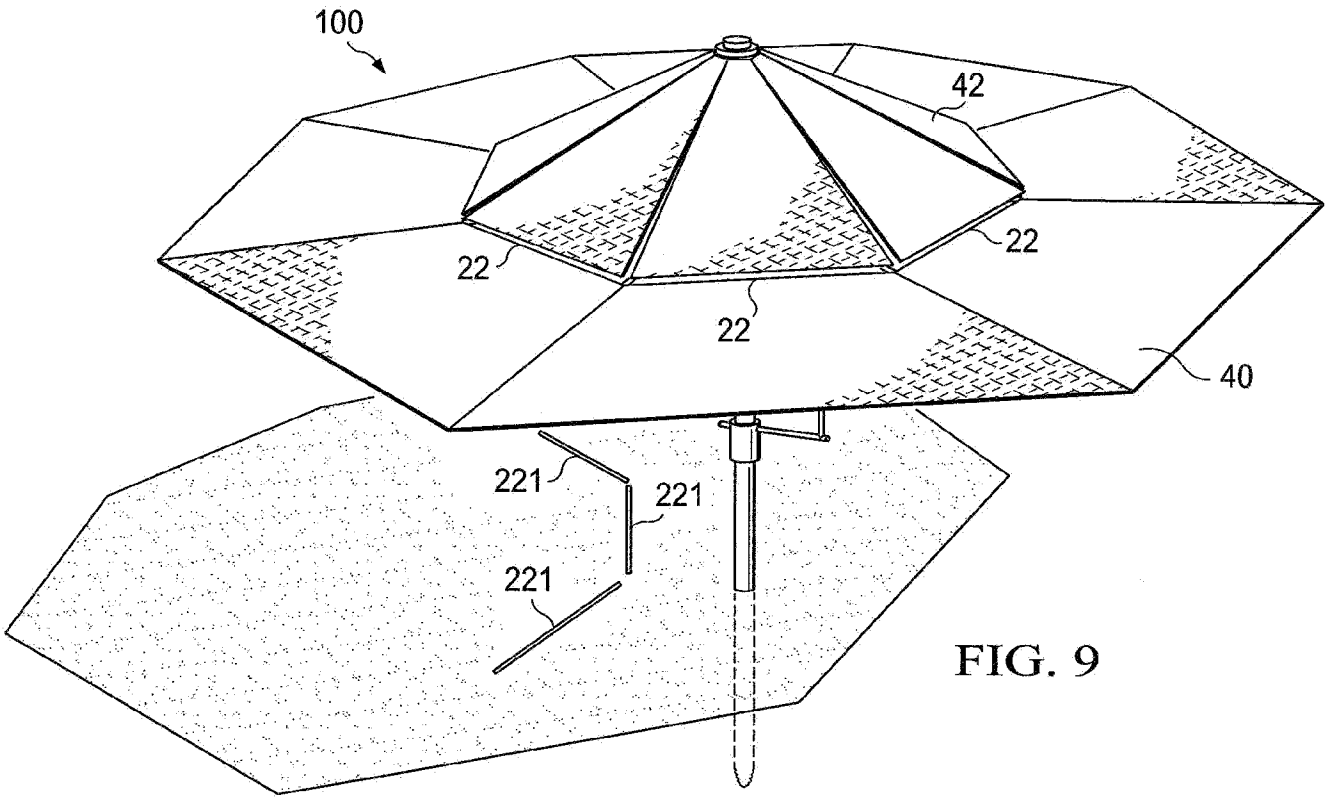
FIG. 9 is a perspective view of the increased size canopy divided in two portions to create the venting openings.

The bi-folding increased coverage beach umbrella keeps the manufacturing processes simplified by using existing manufacturing constructions of conventional beach umbrellas by extending the frame assemblies with twin-rail joints 13 and the folding beam 5 shown in FIG. 5, The bi-folding increased coverage beach umbrella enables to have the increase size and can be divided in two sections to increase the ventilation for air flow in 221 in the shaded area and also to reduce the sail effect as illustrated in FIG. 9. Additionally, this construction withstands weather conditions, preventing the umbrella from turning inside out. The bottom pole 16 may include a drilling tip 19 shown in FIG. 6 to drill the bottom pole 16 to the desired depth in the ground by rotating the handle 18. The long handle bar 20 can be inserted into the hole 21 for the desirable length for easy operation. After inserting the top poll into the collar, the top poll is secured.

Figure 11:
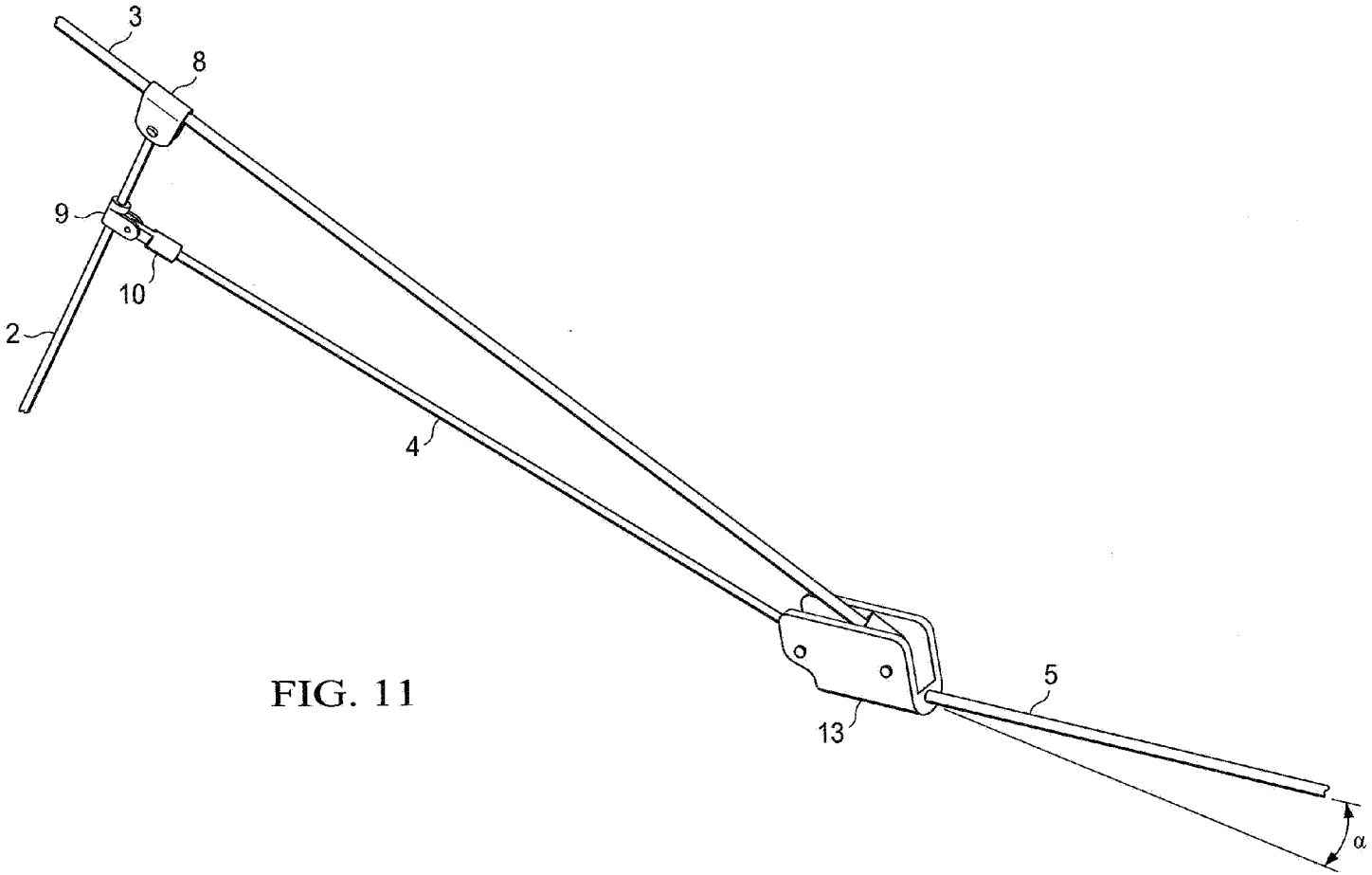
FIG. 11 is a perspective view of the change of the angle of the folding rods.

The bi-folding increased coverage beach umbrella enables the angle of the extended curtain segments to be changed by position of a second latch 9 closer to the lower ring 12 as shown in FIG. 11. The present invention can display a logo by changing the angle of the extended curtain segments.

It is an object of the present invention to provide a dual-folded umbrella having advantage of sturdy but still light weight construction with at least double the covering diameter as compared to the conventional beach or recreational umbrellas.

It is another object of the present invention to provide for easy installation by driving the shank segment in the ground by extended multi-functional handle.

The above and other objects, features and advantages of the present invention will become apparent from following detailed description taken with the accompanying drawings.

Figure 1:
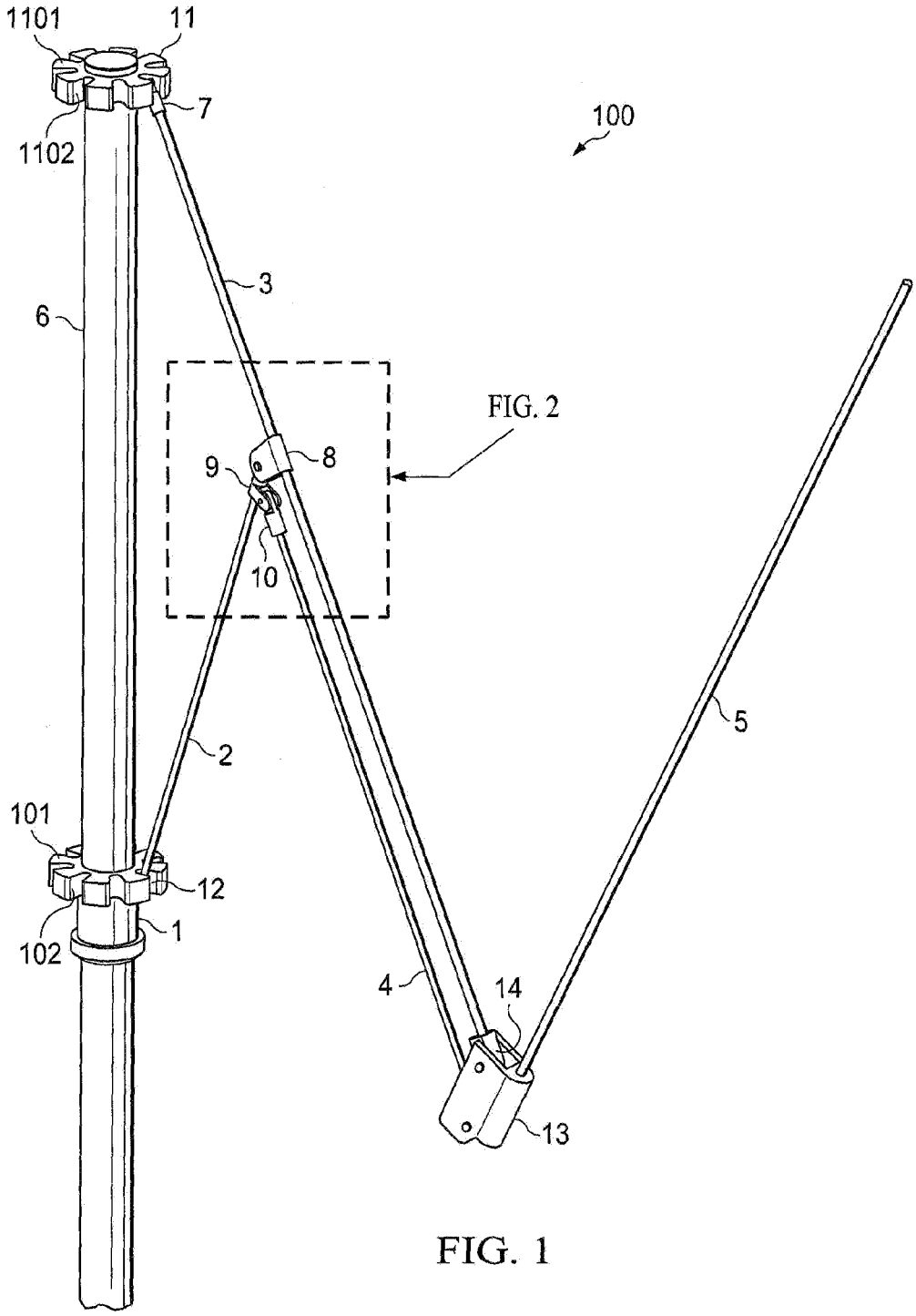
FIG. 1 illustrates a perspective view of the umbrella frame in which the umbrella frame is partially folded.

FIG. 1 illustrates a portion of the poll and frame of the umbrella 100 of the present invention. FIG. 1 illustrates a poll member 6 which may extend substantially vertically when in use. A slider member 1 includes a centrally positioned passageway for the poll member 6 and is positioned on the poll member 6 and includes outwardly extending arms 101 which are separated by a channel 102 to accept the fifth joint connection member 12 which is affixed to the supporting rod frame member 2 and which is connected to pivot within the channel 102. The slider member 1 slides along the poll member 6 within the centrally positioned passageway. At substantially the top of the poll member 6, upper ring member 11 is shown which includes outwardly extending arms 1101 which correspond in position to the outwardly extending arms 101 and channels 1102 which correspond to channels 102. The channel 1102 cooperates with a first joint connection member 7 so that the first joint connection member 7 can pivot with respect to the poll frame member 6. FIG. 1 additionally illustrates a pivot member 8 which along the interior rod stretching member 3 which is affixed to the first joint connecting member 7. The interior rod frame stretching member 3 is affixed to a third joint connecting member 14 which is connected to pivot with respect to the outer rod frame member 5 and pivots within the pivoting member 13. The supporting rod frame member 2 is affixed to the second joint connecting member 9 which is connected to pivot with respect to the pivot member 8. The transferring rod frame member 4 is affixed to the fourth joint connector member 10 at each end of the transferring rod frame member 4. One fourth joint connector member 10 is connected to pivot with respect to the pivot member 8 and the other fourth joint connecting member 10 is connected to pivot to the pivoting member 13.

In operation, as the slider member 1 slides up the poll member 6, the fifth joint connection member 12 and the supporting rod 2 pivots clockwise which pivots the second joint connecting member 9 so that the sliding pivot member 8 moves outwards and upwards, and the fourth joint connecting member 10 by virtue of the connection to the transferring rod frame member 4 pivots the pivoting member 13 clockwise to pivot the outer rod frame member 5 outwards to reach a substantially horizontal position.

Figure 2:
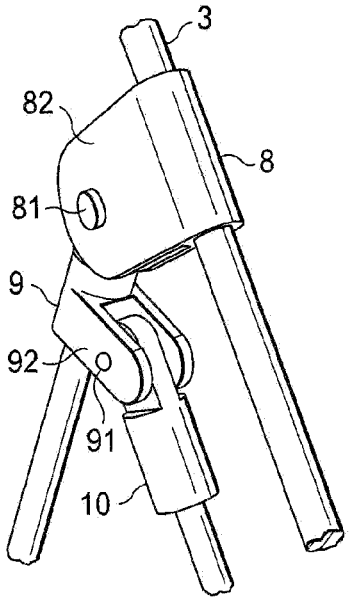
FIG. 2 is a perspective view of at folding joint of the partially folded frame shown in FIG. 1.

FIG. 2 illustrates a detail of the pivot member 8 being connected to pivot to the second joint connecting member 9 which includes a pair of extending arms 92 which extends to connect to the fourth joint connecting member 10 by a pin 91. Consequently, the fourth joint connecting member 10 is connected to pivot with respect to the second joint connecting member 9. The pivot member 8 includes a pair of arms 82 which cooperate with a shaft 81 which allows the second joint connecting member 9 to pivot.

FIG. 3 illustrates the pivoting member 13 which is affixed to the outer rod frame member 5 and illustrates the third joint connecting member 14 which pivots with respect to the pivoting member 13 by virtue of a shaft 141 and which is affixed to the interior rod frame stretching member 3. In similar fashion, the transferring rod frame member 4 is affixed to the fourth joint connecting member 10 which pivots with respect to the pivoting member 13 by virtue of the shaft 142. The pivoting member 13 includes a pair of arms 131, 132 which includes holes for the shafts 141, 142 to rotate.

Figure 4:
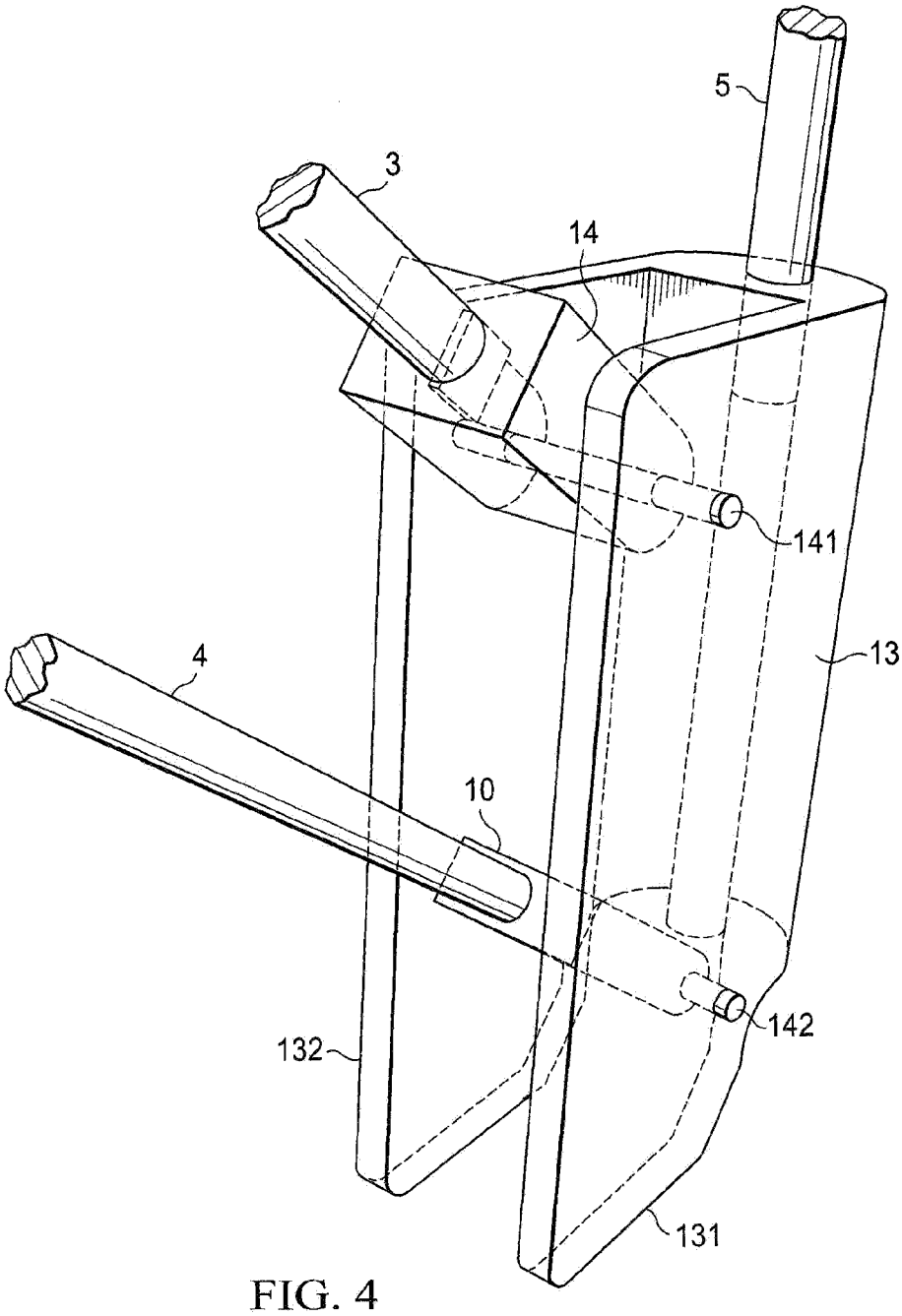
FIG. 4 is a perspective view of a detail of the second folding double rail joint of the partially folded frame shown in FIG. 1.

FIG. 4 illustrates that the pivoting member 13 includes a first arm 131 and a second arm 132 which extends from the pivoting member 13 to cooperate with the third joint connecting member 14 and the fourth joint connecting member 10. The first arm 131 and the second arm 132 includes opposed openings for the shafts 141, 142.

FIG. 5 illustrates the outer rod frame member 5, the supporting rod frame member 2, the interior rod frame stretching member 3, and the transferring rod frame member 4 of the present invention in an extended position.

FIG. 5 additionally illustrates the fourth joint connecting member 10, the pivot member 8 and the pivoting member 13.

Figure 6:
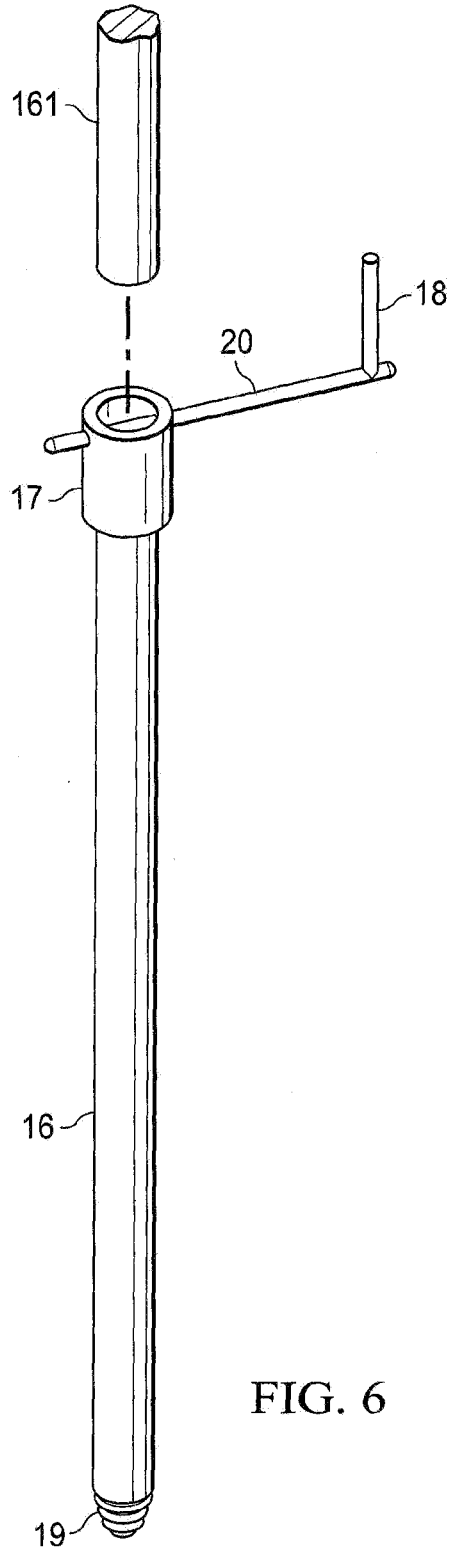
FIG. 6 is a perspective view of the bottom pole of the beach umbrella according to the invention.

The poll member 6 may include more than one member. Furthermore, since the umbrella 100 may be of increased weight, it may be necessary to place the poll member 6 in a fairly deep hole in order to support the umbrella 110. FIG. 6 illustrates the apparatus which could be used to achieve a solution to the above mentioned problem. More particularly FIG. 6 illustrates a lower poll member 16 which is affixed to a collar member 17 which may detachably connected to a upper poll member 161. The lower poll member 16 includes a drill tip member 19 at the distal end of the lower poll member 16 to dig a hole sufficient to support the lower poll member 16 and the umbrella 100. A handle member 18 is connected to a handlebar member 20 which extends through opposing holes formed in the collar member 17 to turn the lower poll member 16 so that the drill tip member 19 can drill into the surface.

Figure 7:
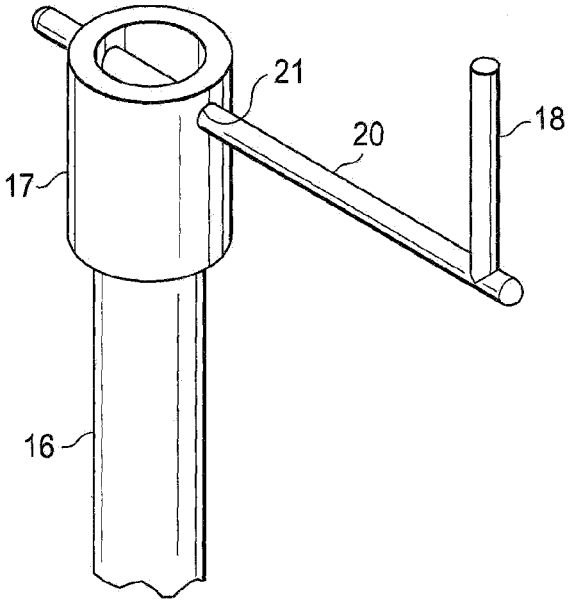
FIG. 7 is another perspective view of the bottom pole embodiment of beach umbrella according to the invention.

FIG. 7 illustrates a detail of the handle member 18 and the handlebar member 20 which extends through the collar member 17 by virtue of opposing holes 21 through the collar member 17.

Figure 8:
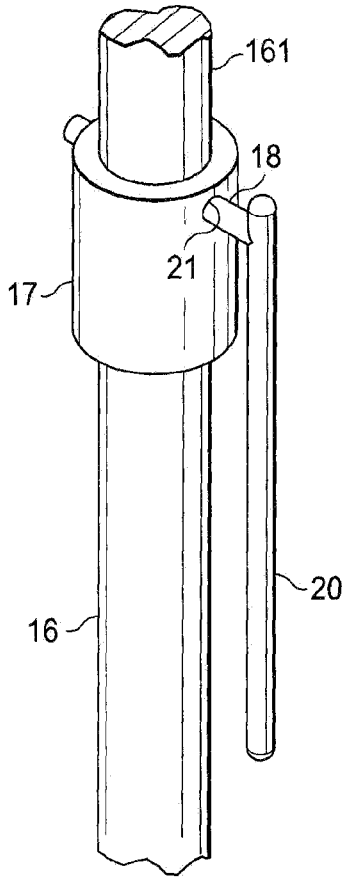
FIG. 8 is another perspective view of the bottom pole embodiment of beach umbrella according to the invention.

FIG. 8 illustrates that the collar member 17 is connected to the lower poll member 16 and with the upper poll member 161. The upper poll member 161 remains detachably connected to the collar member 17 so that the upper poll member 161 can be removed for storage and transportation. The handle member 18 and the handlebar member 20 have been placed in a stowed position so that the handle member 18 is substantially parallel to the lower poll member 16.

FIG. 9 illustrates that the umbrella 100 has been covered with a lower non-continuous covering segment 40 and an upper non-continuous cover segment 42 which may be formed from a flexible material and may be treated to be waterproof. The lower non-continuous covering segment 40 and the upper non-continuous cover segment 42 are adjacent to a slit 22 to allow heat to escape from under the umbrella 100 and to allow the wind to escape from underneath the umbrella 100. The slit 22 may extend around the perimeter of the lower non-continuous covering segment 40 and the upper non-continuous cover segment 42 or may only extend around a few of the lower non-continuous covering segment 40 and the upper non-continuous cover segment 42. The slit 22 may result in non-continuous shade as illustrated by the sunlight 221.

Figure 10:
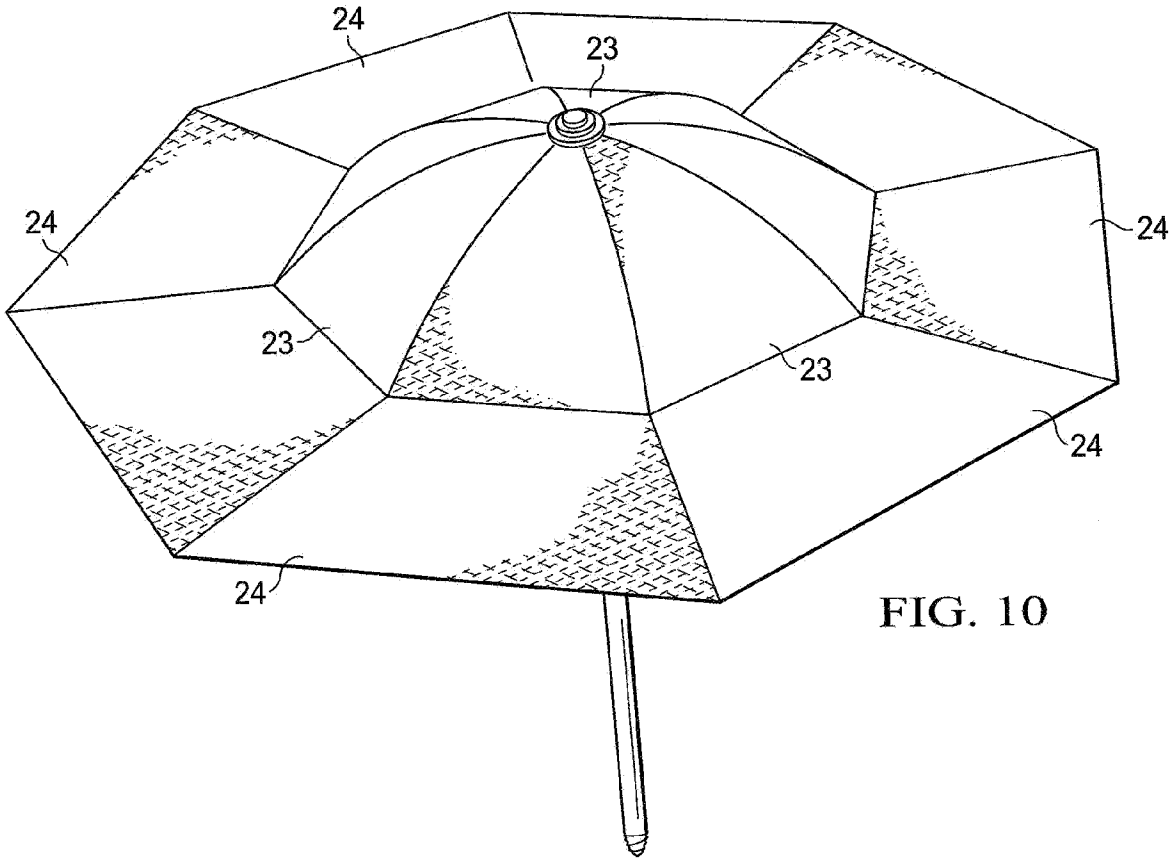
FIG. 10 is a perspective view of the shape variation of the canopy.

FIG. 10 illustrates another embodiment of the umbrella 100 and shows the lower continuous covering segment 24 which is adjacent to the upper continuous covering segment 23.

FIG. 11 illustrates in the umbrella 100 in a second position in which the and outer rod frame member 5 has increased the angle with respect to the increase distance between 10 and 8.

Figure 12:
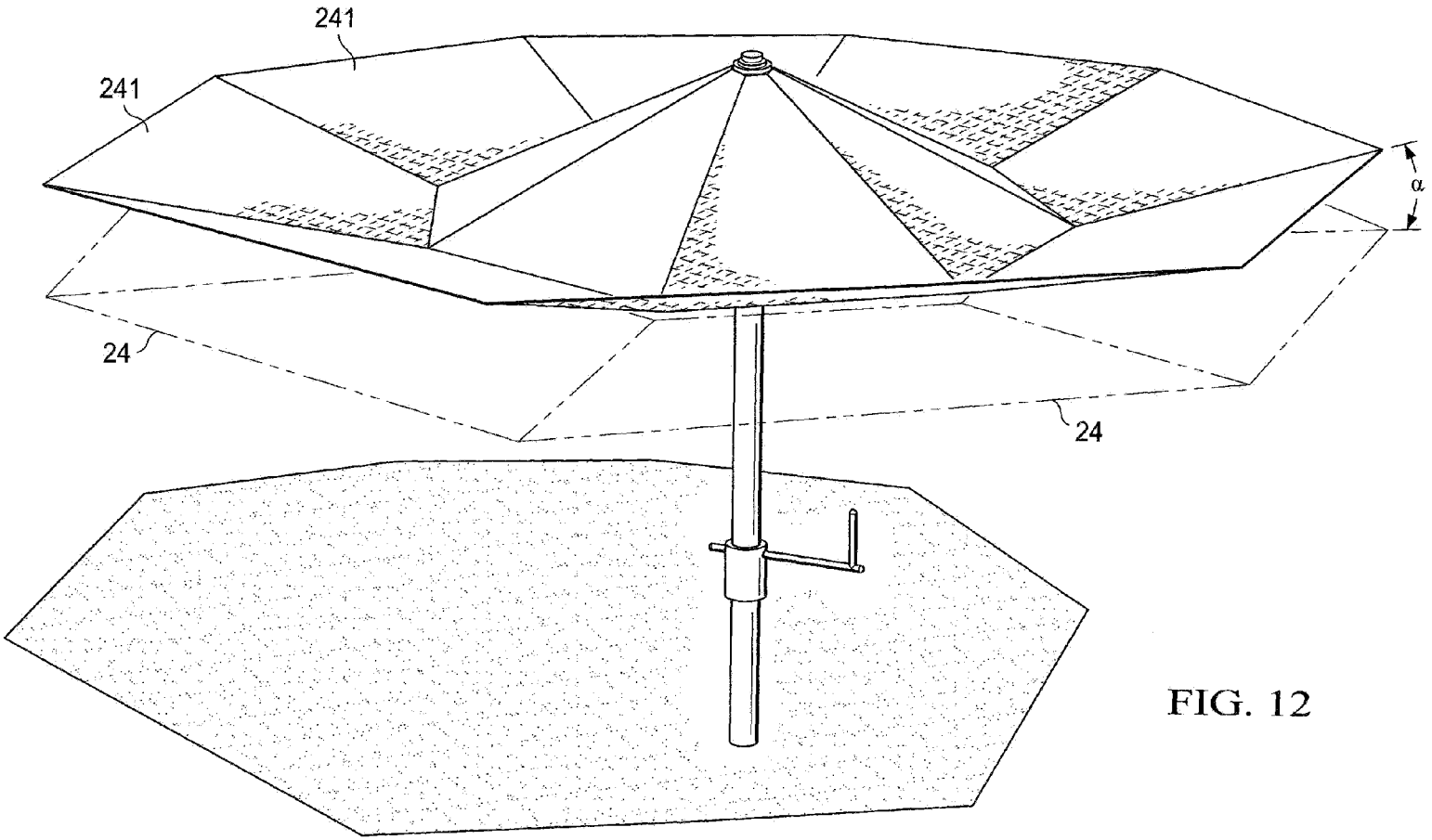
FIG. 12 is a perspective view of a two position umbrella.

FIG. 12 illustrates the umbrella 100 in two positions. The first position corresponds to the outer rod frame member 5, the interior rod frame stretching member 3 and the transferring rod frame member 4 as shown in FIG. 5 and the second position corresponds to the outer rod frame member 5, the interior rod stretching member 3 and the transferring rod frame member 4 for as shown in FIG. 11.

Figure 13:
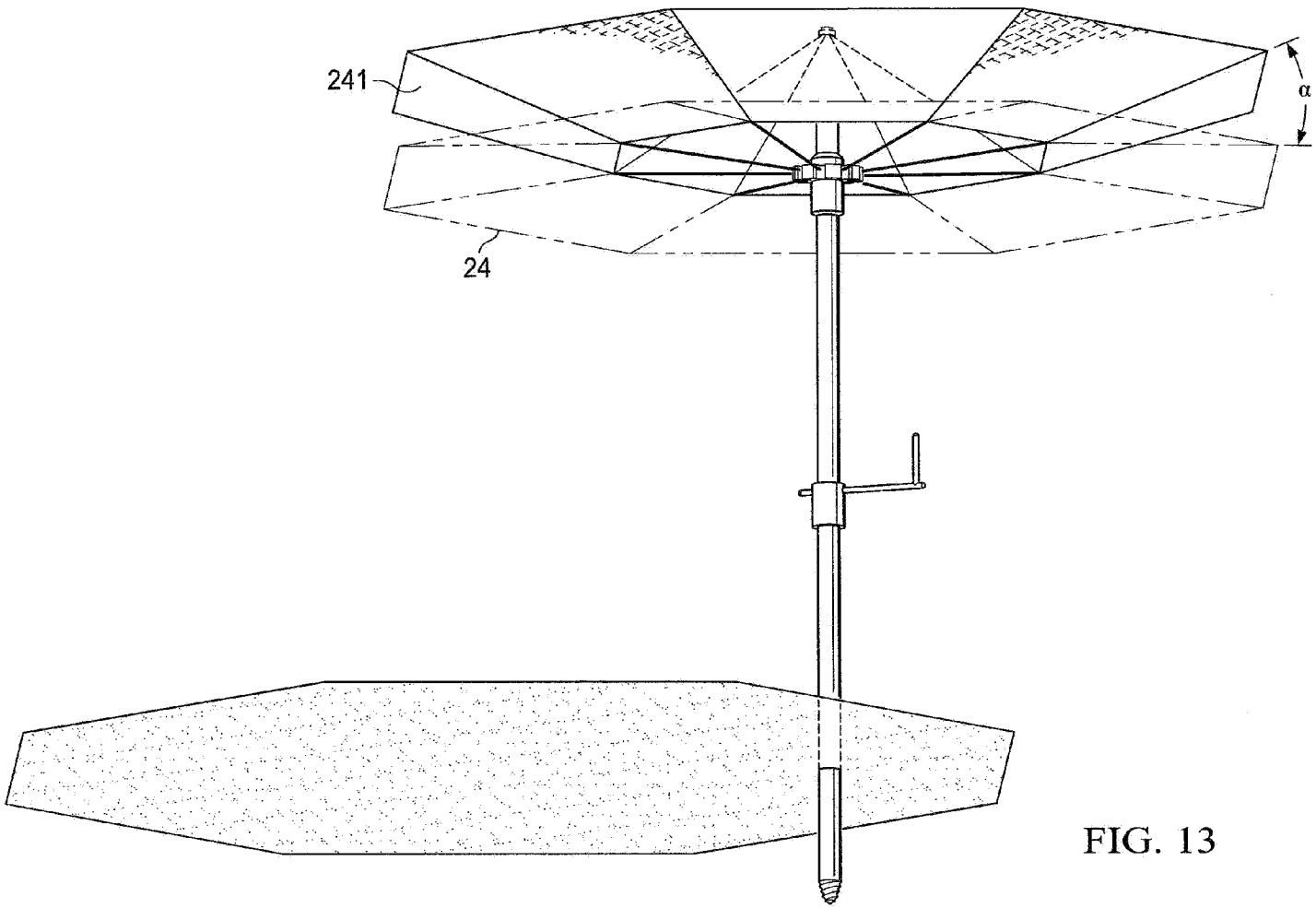
FIG. 13 illustrates another perspective view of the umbrella the present invention.

FIG. 13 illustrates the two positions as shown in FIG. 12 from the underneath of the umbrella 100.

Figure 14:
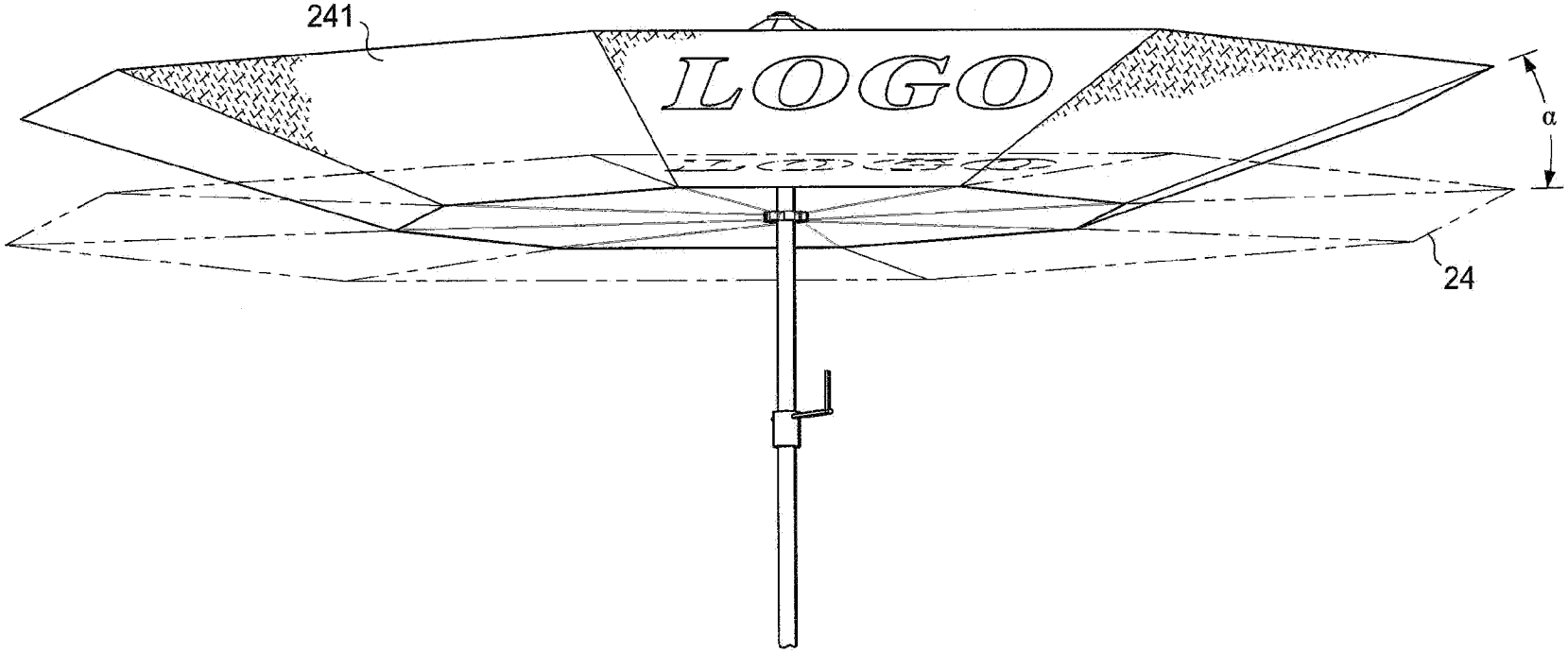
FIG. 14 illustrates a perspective view of the two position umbrella with a logo.

FIG. 14 illustrates that the umbrella 100 in the second position displays a logo better then when in the first position.

Figure 15:
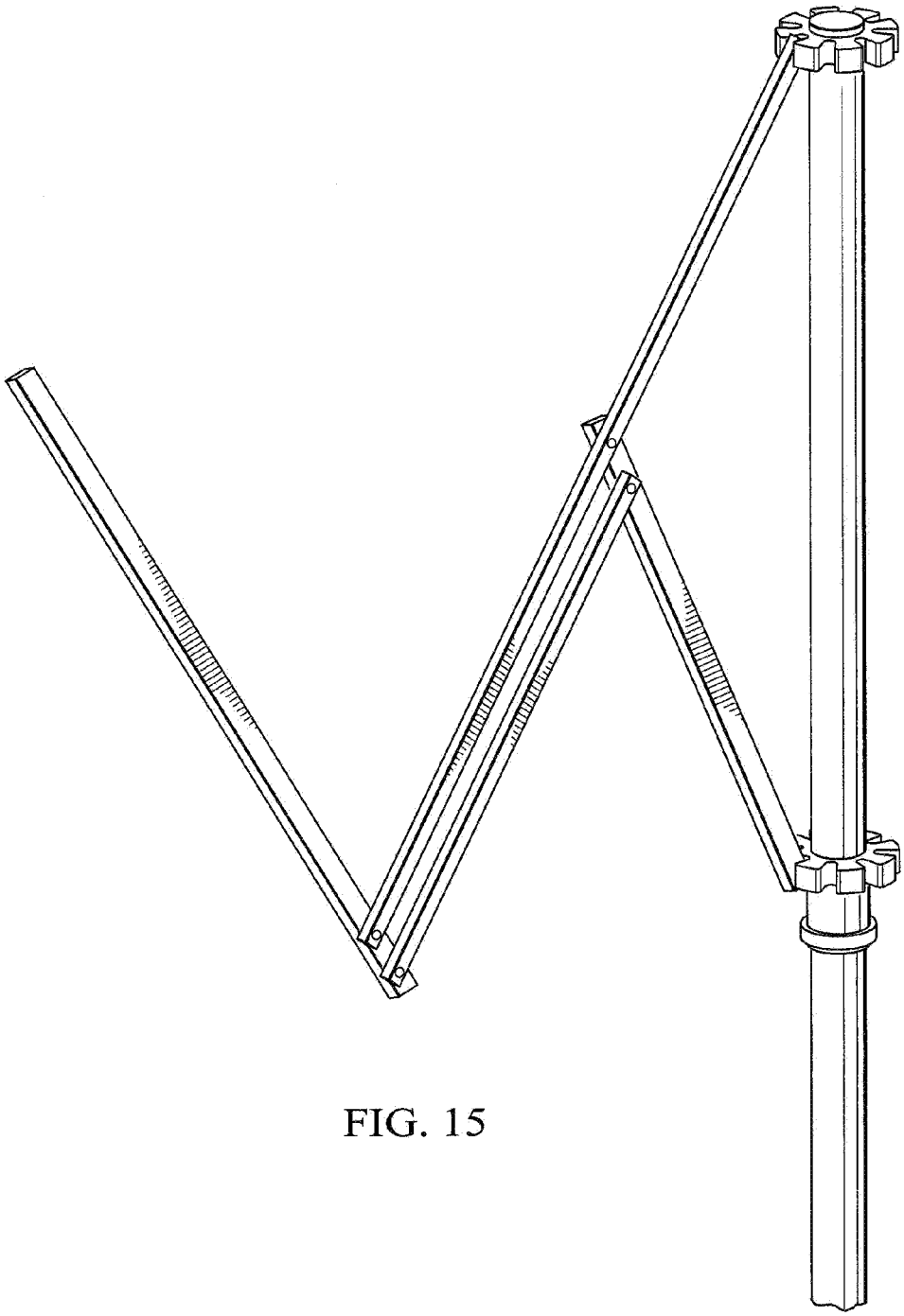
FIG. 15 illustrates a perspective view of the two position umbrella construction applied to a recreational type of frame.

FIG. 15 illustrates a perspective view of the two position umbrella construction applied to a recreational type of frame.

Figure 16:
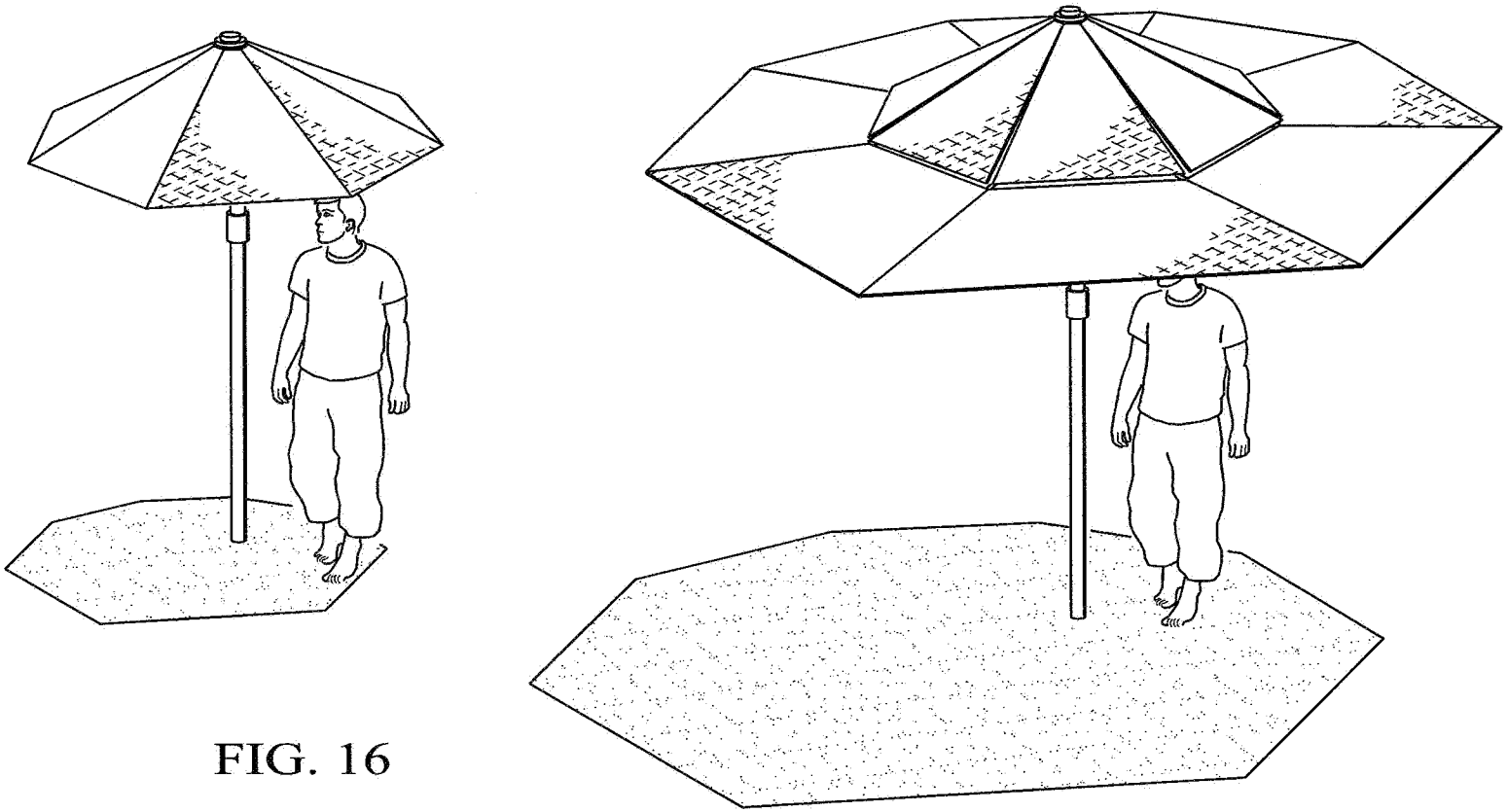
FIG. 16 illustrates the comparable sizes between the conventional beach umbrella and the dual folded umbrella 100

FIG. 16 illustrates the comparable sizes between the conventional beach umbrella and the dual folded umbrella 100

Figure 17:
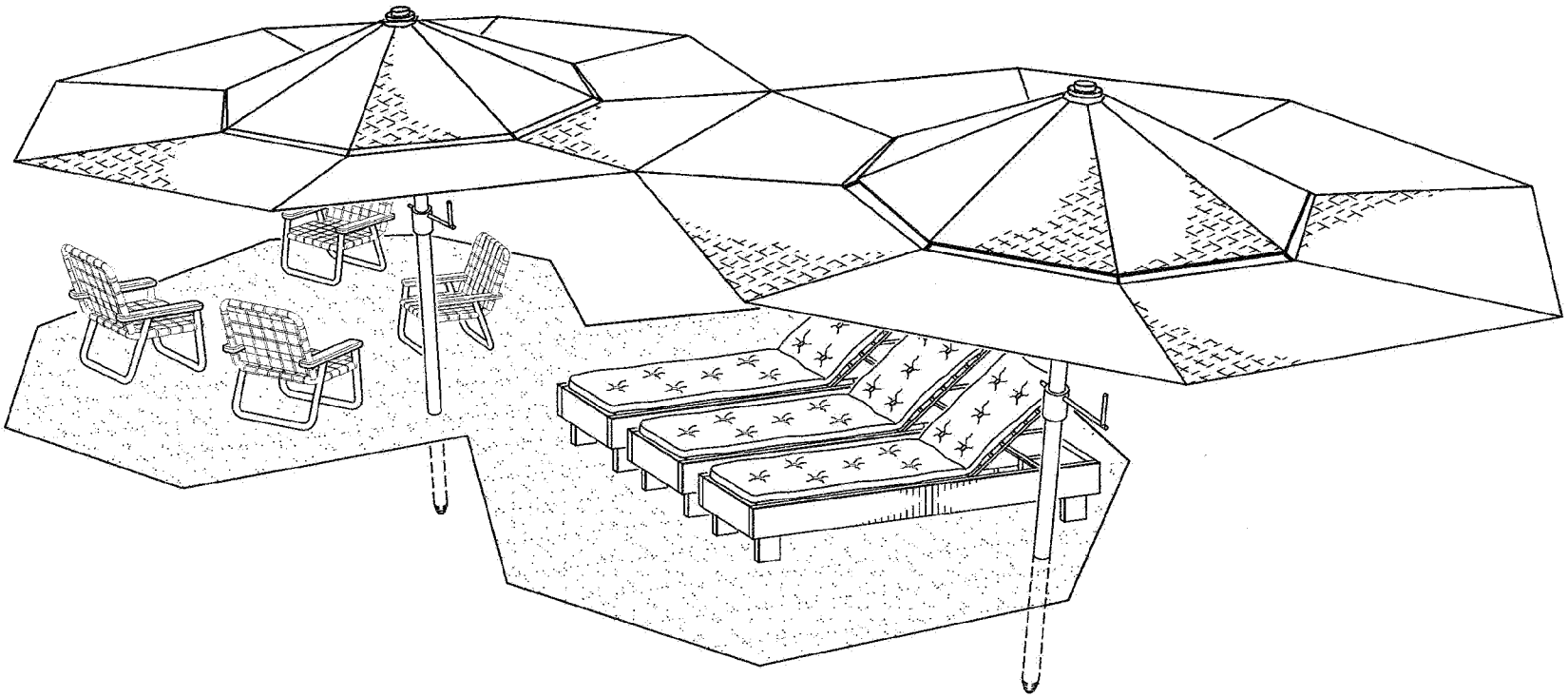
FIG. 17 illustrates the grouping of two dual folded umbrella 100 combined together

FIG. 17 illustrates the grouping of two dual folded umbrella 100 combined together.

While the invention is susceptible to various modifications and alternative forms, specific embodiments thereof have been shown by way of example in the drawings and are herein described in detail. It should be understood, however, that the description herein of specific embodiments is not intended to limit the invention to the particular forms disclosed.

The invention claimed is:

1. An umbrella to provide a shade, comprising: a poll member; an upper ring member at substantially a top of the poll member; a slider member which is movable along the poll member; a interior rod frame stretching member pivotally connected to the upper ring member; a support rod frame member having a first end pivotally connected to the slider member, the support rod frame member having the second end being fixed to a first joint connecting member being pivotally connected to a first pivoting member that is slideably mounted on the interior rod frame stretching member; a transfer rod frame member having a first end pivotally connected to the first join connecting member of the support rod frame member; an outer rod frame member pivotally connected to an outer end of the interior rod frame stretching member and a second end of the transfer rod frame member by a second pivoting member; a first noncontinuous covering to provide a first portion of the shade for the umbrella; a second noncontinuous covering to provide a second portion of the shade for the umbrella; wherein the first noncontinuous covering and the second noncontinuous covering defining a continuous slit around a periphery of the first noncontinuous coveting and the second noncontinuous covering, and the second noncontinuous covering being supported on and pivoted by the outer rod frame member.

2. An umbrella to provide shade as in claim 1, wherein the slider member includes a first slider arm.

3. An umbrella to provide shade as in claim 2, wherein the slider member includes a second slider arm.

4. An umbrella to provide shade as in claim 1, wherein the first joint connecting member includes a first joint arm.

5. An umbrella to provide shade as in claim 4, wherein the first joint connecting member includes a second joint arm.

6. An umbrella to provide shade as in claim 4, wherein the first end of the transfer rod frame member is connected to a second joint connecting member.

7. An umbrella to provide shade as in claim 6, wherein the second joint connecting member is pivotally connected between the first and second joint arms of the first joint connecting member.

8. An umbrella to provide shade as in claim 1, wherein the second pivoting member includes a first extending arm.

9. An umbrella to provide shade as in claim 8, wherein the second pivoting member includes a second extending arm.

10. An umbrella to provide shade as in claim 9, wherein the second pivoting member includes a third joint connecting member affixed to the outer end of the interior rod frame stretching member.

11. An umbrella to provide shade as in claim 10, wherein the third joint connecting member pivots between the first and second extending arm.

12. An umbrella to provide shade as in claim 9, wherein the second pivoting member includes a fourth joint connecting member affixed to the second end of the transfer rod frame member.

13. An umbrella to provide shade as in claim 12, wherein the fourth joint connecting member pivots between the first and second pivoting arms.

14. An umbrella to provide shade as in claim 9, wherein the second pivoting member is connected to the outer rod frame member.

15. An umbrella to provide shade as in claim 1, wherein the umbrella further comprises:

a lower pole member including a drill tip member to drill a hole to support the umbrella;

a collar member to connect to the lower pole members;

a handle member connected to the collar member and adapted to rotate the drill tip member; and the poll member providing an upper pole member to support the umbrella and to be connected to the collar member.

16. An adjustable handle as in claim 15, wherein the handle to provide a stowed position.

* * * * *